US009674593B2

(12) United States Patent
Gautama et al.

(10) Patent No.: US 9,674,593 B2
(45) Date of Patent: Jun. 6, 2017

(54) LOUDSPEAKER CONTROLLER

(71) Applicant: NXP B.V., Eindhoven (NL)

(72) Inventors: Temujin Gautama, Leuven (BE); Alan OCinneide, Brussels (BE); Lutsen Ludgerus Albertus Hendrikus Dooper, Brummen (NL)

(73) Assignee: NXP B.V., Eindhoven (NL)

( * ) Notice: Subject to any disclaimer, the term of this patent is extended or adjusted under 35 U.S.C. 154(b) by 65 days.

(21) Appl. No.: 14/573,653

(22) Filed: Dec. 17, 2014

(65) Prior Publication Data

US 2015/0181318 A1 Jun. 25, 2015

(30) Foreign Application Priority Data

Dec. 24, 2013 (EP) ..... 13199568

(51) Int. Cl.
*H04R 29/00* (2006.01)
*H04R 1/00* (2006.01)
*H04R 3/00* (2006.01)

(52) U.S. Cl.
CPC ..... *H04R 1/00* (2013.01); *H04R 3/00* (2013.01); *H04R 3/002* (2013.01); *H04R 3/007* (2013.01); *H04R 29/001* (2013.01); *H04R 29/003* (2013.01)

(58) Field of Classification Search
CPC ..... H04R 3/002; H04R 3/007; H04R 29/003; H04R 29/001; H04R 1/00; H04R 3/00
See application file for complete search history.

(56) References Cited

U.S. PATENT DOCUMENTS

2004/0086140 A1* 5/2004 Fedigan ..... H04R 3/00 381/96
2013/0077795 A1 3/2013 Risbo et al.
2013/0251164 A1* 9/2013 Gautama ..... H04R 29/001 381/59
2013/0251167 A1 9/2013 Gautama
2014/0241536 A1* 8/2014 Adams ..... H04R 29/003 381/59
2015/0312679 A1* 10/2015 Little ..... H04R 9/06 381/398

FOREIGN PATENT DOCUMENTS

EP 2 355 542 A1 8/2011
EP 2 538 699 A1 12/2012
WO 2009/010055 A1 1/2009

OTHER PUBLICATIONS

Klippel. W. "Loudspeaker Nonlinearities—Causes, Parameters, Symptoms", J. Audio Engineering Society, pp. 119 (Oct. 2005).
Dodd, M. et al. "Voice Coil Impedance as a Function of Frequency and Displacement", J. Audio Engineering Society, pp. 119 (Oct. 2004).
Extended European Search Report for EP Patent Appln. No. 13199568.0 (May 8, 2014).

* cited by examiner

*Primary Examiner* — Regina N Holder
(74) *Attorney, Agent, or Firm* — Rajeev Madnawat

(57) ABSTRACT

A loudspeaker controller (1) for controlling a loudspeaker (2), configured to determine time-varying impedance information of the loudspeaker (2) based on a loudspeaker voltage and a measure of a loudspeaker current and provide for control of the loudspeaker (2) in accordance with said time-varying impedance information.

17 Claims, 2 Drawing Sheets

LOUDSPEAKER CONTROLLER

CROSS-REFERENCE TO RELATED APPLICATIONS

This application claims the priority under 35 U.S.C. §119 of European patent application no. 13199568.0, filed on Dec. 24, 2013, the contents of which are incorporated by reference herein.

This invention relates to a method of controlling an output of a loudspeaker. It also relates to a loudspeaker controller. Further, the invention relates to a method and controller for mechanical loudspeaker protection.

A loudspeaker is a device having a voicecoil that moves a diaphragm and converts an electrical signal into an acoustic one. For small electrical signals, for which the diaphragm displacement is small, an accurate linear transfer function can be defined between an input voltage signal and the diaphragm displacement function. However, for input signals that result in a larger diaphragm displacement, the linear model is invalid, due to the nonlinear behaviour of the loudspeaker and predictions of the displacement of the diaphragm based upon a linear transfer function are inaccurate. Mechanically protecting a loudspeaker such that its diaphragm displacement is not overly conservative while remaining within the bounds prescribed by the manufacturer under large-amplitude signal conditions is therefore a challenging problem.

According to a first aspect of the invention we provide a loudspeaker controller for controlling a loudspeaker, configured to determine time-varying impedance information of the loudspeaker based on a loudspeaker voltage and a measure of a loudspeaker current and provide for control of the loudspeaker in accordance with said time-varying impedance information.

This is advantageous as it has been found that how aspects of the impedance value change over time is indicative of the inductance of the loudspeaker, which is indicative of the instantaneous loudspeaker displacement. Accordingly, a loudspeaker can be controlled to provide mechanical protection, for example. The utilisation of measurements of the short-term instantaneous variations of the impedance of an operating loudspeaker as an indication of its diaphragm displacement provides a convenient and non-computationally intensive way of providing loudspeaker protection and/or input signal processing.

The controller may be configured to introduce a measurement signal of a predetermined frequency into an input signal for the loudspeaker, and measure the loudspeaker current of the loudspeaker at said predetermined frequency.

The controller may be configured to measure a loudspeaker voltage and the loudspeaker current. Alternatively, the loudspeaker voltage may be calculated from an input signal applied to the loudspeaker using predetermined parameters of an amplifier used to amplify said input signal. For example, the nonlinear distortion of the amplifier may be modelled by applying a clipping function to the input signal.

The measurement signal may comprise a pilot tone of predetermined frequency. The pilot tone may have a frequency outside the audible range. The measurement signal may comprise a plurality of pilot tones, each having a different frequency, and the controller may be configured to determine time varying impedance information at each frequency corresponding to the plurality of pilot tones. The time-varying impedance information at the plurality of frequencies may be used to create a model from which the loudspeaker displacement can be determined. The pilot tones may have sinusoidally oscillating waveforms.

The measurement signal may comprise noise introduced into the input signal over a particular frequency range. The frequency range may be narrow, such as 100 Hz.

The use of a single pilot tone provides the simplest method as it represents a single point in the frequency domain. Including multiple pilot tones may make the measurement more robust, but may add to the complexity of the measurement as there are more data points. The use of noise may be robust, as it spans a larger frequency region, but may also add complexity to the measurement procedure.

In other embodiments, the measurement signal comprises a selected part of the input signal. The selected part may be selected based on the signal energy in that part of the input signal.

The controller may be configured to use a short-time Fourier transform technique to determine the time-varying impedance information. Alternatively, the controller may be configured to use the Goertzel algorithm or a filter bank to determine the time-varying impedance information. It will be appreciated that any algorithm which can estimate the impedance at a specific frequency point is suitable.

The controller may be configured to control the loudspeaker by;

a) acoustic signal processing of the input signal; or b) implementing loudspeaker protection.

Further the controller may be configured to control the loudspeaker by;

- controlling the gain of an audio signal, e.g. by applying an attenuation factor
- applying a linear filter to an audio signal, e.g. high-pass filtering
- operating a dynamic range compressor which controls the gain applied to the audio signal based on the time varying impedance information (side-chaining)

The controller may be configured to derive a diaphragm displacement value from the time-varying impedance information.

The controller may be configured to control the loudspeaker by acoustic signal processing of the input signal applied to the loudspeaker. The controller may be configured to lower a gain of an amplifier supplying the input signal to the loudspeaker if the amplitude of the time-varying impedance information exceeds a threshold. The acoustic signal processing may comprise modifying an input signal applied to the loudspeaker to lower the expected excursion if the time-varying impedance information exceeds a predetermined threshold.

The controller may be configured to compare the time-varying impedance information and/or the derived diaphragm displacement with a predetermined parameter for control of the loudspeaker. The parameter may represent a threshold and the controller may be configured to determine whether the time-varying impedance information exceeds said threshold and provide for control of the loudspeaker. The loudspeaker controller may only control the loudspeaker if said threshold is exceeded. The parameter may comprise one or two bounds and the controller may be configured to determine if the time-varying impedance information exceeds said bounds. The controller may provide for control of the loudspeaker if the bounds are exceeded. The bounds may comprise impedance limits or a derivatives thereof. The impedance bounds may comprise the magnitude of the impedance or a real part of the impedance or an imaginary part of the impedance. It will be appreciated that which aspect of the impedance is used to set said bounds depends on application. The parameter/bounds may be derived by calibration of said loudspeaker. The parameter may comprise a function specifying different degrees of control depending on the time-varying impedance information.

According to a second aspect of the invention we provide a method of controlling an output of a loudspeaker comprising the steps of;

measuring a loudspeaker current, the loudspeaker having an input signal applied thereto;

determining time-varying impedance information of the loudspeaker based on a loudspeaker voltage and the measured loudspeaker current; and providing for control of the loudspeaker in accordance with said time-varying impedance information.

According to a third aspect of the invention we provide an integrated circuit (IC) including the loudspeaker controller as defined in the first aspect.

According to a fourth aspect of the invention we provide an electronic device including a loudspeaker and the loudspeaker controller of the first aspect of the invention.

The electronic device may comprise a mobile telephone, a tablet computer, a radio, an in-car entertainment system, an MP3 player or any other audio output device.

There now follows, by way of example only, a detailed description of embodiments of the invention with reference to the following figures, in which.

The present invention relates to a loudspeaker controller which may be implemented to protect the loudspeaker to extend the life of the loudspeaker and maintain high quality audio output over its life by processing the acoustic signal supplied to drive the loudspeaker.

Figure 1:
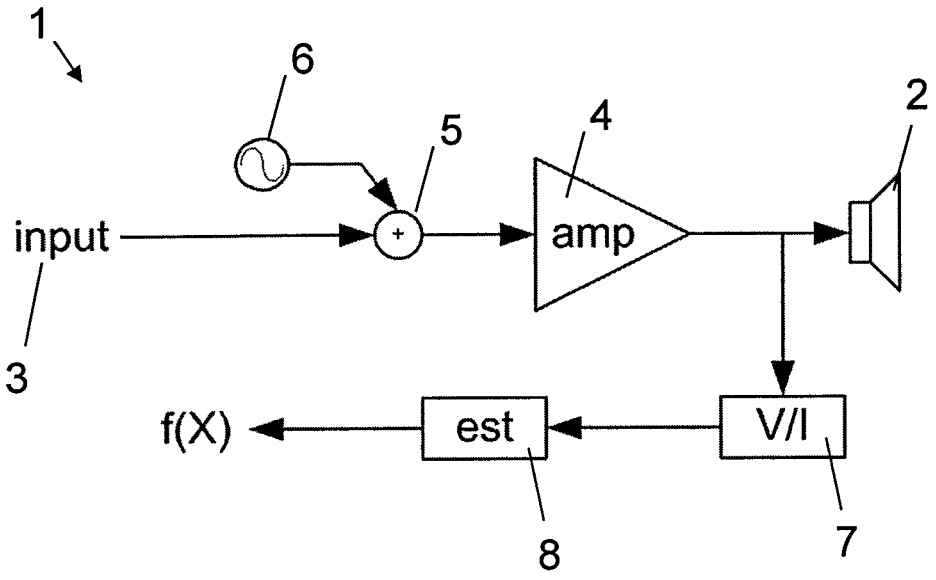
FIG. 1 shows a first example embodiment of a loudspeaker controller.

FIG. 1 shows an embodiment of a loudspeaker controller 1 for controlling an output of a loudspeaker 2. The loudspeaker 2 is driven by an input signal 3, which is amplified by an amplifier 4. The controller 1 includes a mixer element 5 arranged prior to the amplifier 4 for introducing a measurement signal, generated by a measurement signal generator 6, into the input signal. The controller 1 includes a sensor 7 configured to measure a voltage across and a current flowing through the voice coil of the loudspeaker 2. An impedance calculation element 8 is configured to receive the measured voltage and current and, using the measurement signal, determine time-varying impedance information of the loudspeaker. A displacement of a diaphragm of the loudspeaker or a measure related to it, shown as f(X), can be derived from the time-varying impedance information. The controller 1 can therefore use said time-varying impedance information to control the loudspeaker 2. The controller may control the input signal as a function of the time-varying impedance information.

The loudspeaker 2 may be of any known type. The loudspeaker 2, as is conventional, has a voicecoil connected to a cone of the loudspeaker. The voicecoil provides a motive force to the cone by current flowing through it providing a reaction in the presence of a magnetic field. The current flowing through the voicecoil and the voltage applied across the voicecoil are measured by the sensor 7. The controller 1 does not need to know any physical parameters of the loudspeaker, such as the mechanical mass of the loudspeaker nor the make or model. The displacement of the cone/voicecoil can be derived from the time-varying impedance of an operating loudspeaker and can therefore be controlled to provide mechanical protection. The impedance measures obtained over time can be utilised for mechanical loudspeaker protection algorithms, which may have increased robustness and reduced computational complexity than prior art methods.

The input signal 3 may comprise a digital signal or an analogue signal. If the input signal is a digital signal, the controller may include a digital to analogue converter so that an analogue signal can be presented to the amplifier and loudspeaker 2. The amplifier 4 may be of any suitable type for audio amplification.

The measurement signal generator 6, in this embodiment, is configured to generate a measurement signal comprising a pilot tone. The pilot tone comprises a sine wave having a frequency ω0 outside the audio band, such as 22 kHz. It will be appreciated that other frequencies, inside or outside the audible band may be used. The pilot tone is combined with the input signal prior to the amplifier 4. Thus, the input signal and pilot tone are amplified and provided to the loudspeaker 2. The amplitude of the pilot tone is low and in this embodiment comprises substantially 1% of the input signal. It will be appreciated that the amplitude of the pilot tone can be altered depending on the dynamic range of the current/voltage sensors described below.

The impedance calculation element 8 receives a plurality of instantaneous measurements of the voltage and current from the sensor 7. The sensor may sample the voltage and current at a frequency greater than the frequency of the measurement signal. In this example, a frequency of 96 kHz is used. Thus, the plurality of measurements describe the changes in voltage and current in the loudspeaker 2. The sensor 7 may be configured to measure the voltage and current over a wide range of frequencies or, alternatively, it may be configured to measure the voltage and current at the frequency of the measurement signal/pilot tone.

The impedance calculation element 8 is configured to calculate an impedance value for each of the voltage and current measurements.

It has been found that information about the excursion of the loudspeaker can be derived from how the impedance of the loudspeaker and how it changes over time. In particular, the inductance of the voicecoil can yield information about the excursion of the loudspeaker and information of the voice coil inductance of the loudspeaker is contained within its electrical impedance function. The impedance function is estimated as the ratio of the voltage across the voice coil to the current through it. Mathematically, this can be expressed as:

$$Z(\omega) = \frac{V(\omega)}{I(\omega)} \tag{1}$$

where V(ω), I(ω) and Z(ω) are the voltage, current and electrical impedance of the loudspeaker voice coil at frequency ω.

The electrical impedance can be determined by the impedance calculation element 8 by a number of different methods. In this embodiment, the element 8 receives from the sensor 7 the voltage and current signals, from which the voltage at frequency ω0, V(ω0), and the current at frequency ω0, I(ω0), can be computed using a frequency-domain estimation technique. The element 8 has knowledge of the waveform of the pilot tone and its frequency. In this embodiment a short-time Fourier transform is used, although it will be appreciated that any algorithm which can estimate the impedance at a specific frequency point is suitable.

The element 8 can then calculate the ratio Z(ω0) from these quantities according to Equation (1) above.

When the impedance, from the voltage and current values, is estimated in a short-time manner, the time-varying nature of the complex Z(ω0) can be captured. Accordingly a time-varying measure may be derived from Z(ω0), by taking the Z(ω0) as such, or a component of it, e.g its real-valued part, imaginary part or some other measure. This time-varying measure has been found to be related by a function "f(X)" to the instantaneous diaphragm displacement X. The impedance of a loudspeaker will vary with instantaneous displacement. The above method advantageously isolates the varying inductance part and it is found that this measure varies (almost) proportionally with the loudspeaker displacement.

The measurement signal generator 6 and impedance calculation element may be configured to determine the impedance using alternate methods. For example, the measurement signal generator 6 may be configured to introduce noise into the input signal over a particular frequency band. The noise may have a bandwidth of 100 Hz. Then, identification techniques such as a short-time estimation cross-correlation function, can be utilised to determine the characteristics of Z(ω0) in the particular frequency region where the narrowband noise has been centred.

In a further example, multiple pilot tones may be introduced. For example, three pilot tones may be introduced into the input signal at three different frequencies ω1, ω2 and ω3 and the impedance Z(ω1), Z(ω2) and Z(ω3) at those frequencies determined. The multiple pilot tones may or may not be in the audible range.

The impedance calculation element may be configured to fit an impedance model to the data obtained. The impedance model represents the loudspeaker excursion vs time-varying impedance. The speaker's excursion limit may be determined from a calibration step based on determined impedance values. Thus the calibration step may include measuring both the time-varying impedance and e.g. a laser displacement meter or some acoustical measurements to determine loudspeaker displacement.

The controller may be configured to use the time-varying impedance information to provide feedback to a further excursion protection element.

Figure 2:
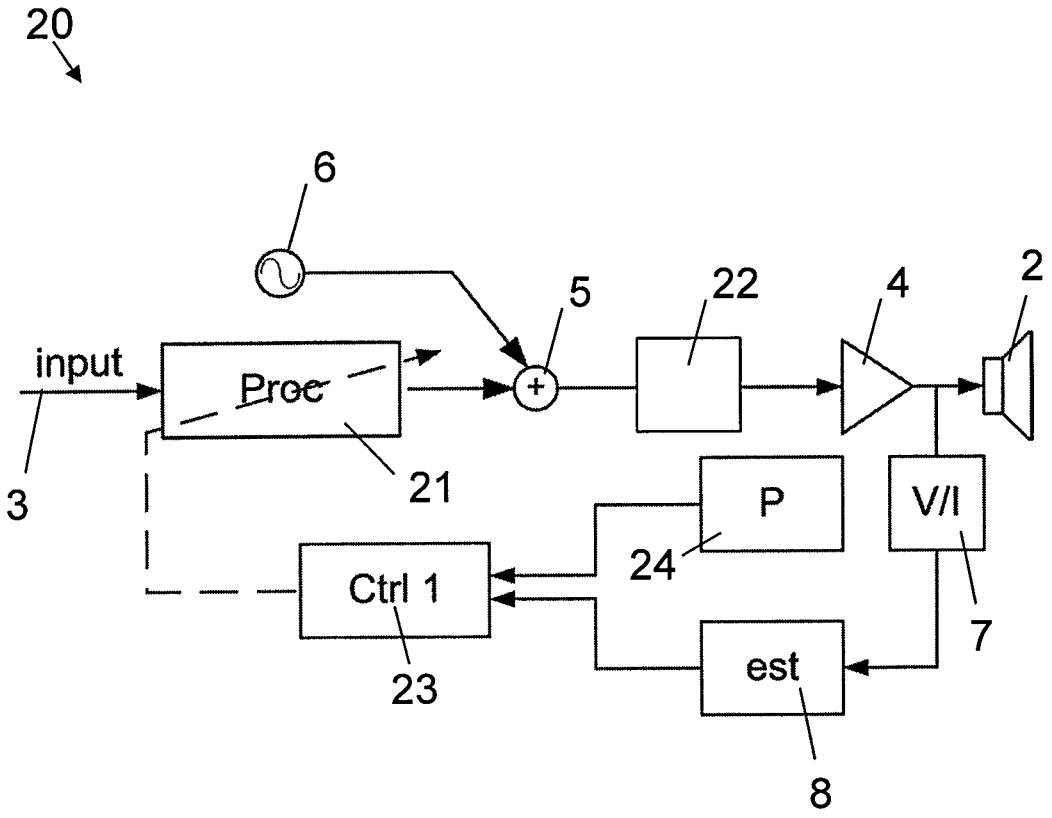
FIG. 2 shows a second example embodiment of a loudspeaker controller.

The displacement x obtained in FIG. 2 may be used to modify the input signal. For example, if the displacement x is determined to be approaching a limit of the loudspeaker, the input signal may be modified to reduce the amplitude of the input signal to within the limits of the loudspeaker or to achieve a limited amount of harmonic distortion in the acoustical output. Thus, the controller may compare the impedance values with predetermined bounds to determine if the loudspeaker is approaching or exceeding an excursion limit.

FIG. 2 shows a second embodiment of the invention, which provides mechanical loudspeaker protection. The same reference numerals have been used where appropriate. The controller 20 is substantially similar to the embodiment in FIG. 1. The input signal 3 is a digital signal and is received by a signal processor 21 for processing prior to driving the loudspeaker 2. The measurement signal generator 6 introduces a pilot tone digitally into the processed input signal 3. The processed input with pilot tone is sent to a digital-to-analogue converter 22, which converts the digital signal into an analogue signal for amplification by amplifier 4. The amplified signal is sent to the loudspeaker 2. As in the previous embodiment, the loudspeaker voicecoil voltage and current are measured using the sensor 7 and the time varying impedance measure and possibly other impedance-related measures are calculated in the impedance calculation element 8.

In this embodiment, the controller includes a signal processor controller 23, which receives the time-varying impedance values from the element 8. The signal processor controller 23 also receives one or more parameters from a memory 24. The parameters may be user set or predetermined. The predetermined parameters may be derived from a loudspeaker calibration step to identify the relationship between displacement and impedance. The user-defined/predetermined parameters ("P") may be a variety of different quantities, dependent upon the precise application of the invention. As one example, the parameters may be an impedance variation threshold or bounds, which corresponds to a degree of desired diaphragm displacement. Alternatively, the parameters may comprise a threshold value corresponding to a 'safe' degree of displacement for the loudspeaker where nonlinear distortion is acceptable and the loudspeaker is operating within its manufacturer prescribed limits. Alternatively, a 'strict' excursion threshold value may be selected, below which nonlinear distortions are not introduced and the loudspeaker behaves in a linear fashion. Further, the controller may be configured to compare the time-varying impedance information with the parameters. The comparison may be based on the magnitude of the impedance, the real part of the impedance or the imaginary part of the impedance. Alternatively, a derivative of the impedance may be used.

The signal processor controller 23 adjusts the operation of the signal processor 21 as a function of the time varying impedance measure in accordance with the parameters. For example, the controller 23 may cap the amplitude of the input signal if the time varying impedance values exceed a value set by the parameters, p. In another example, the controller 23 may cause the filtering of the input signal or the controller may implement dynamic range compression via side-chaining.

Figure 3:
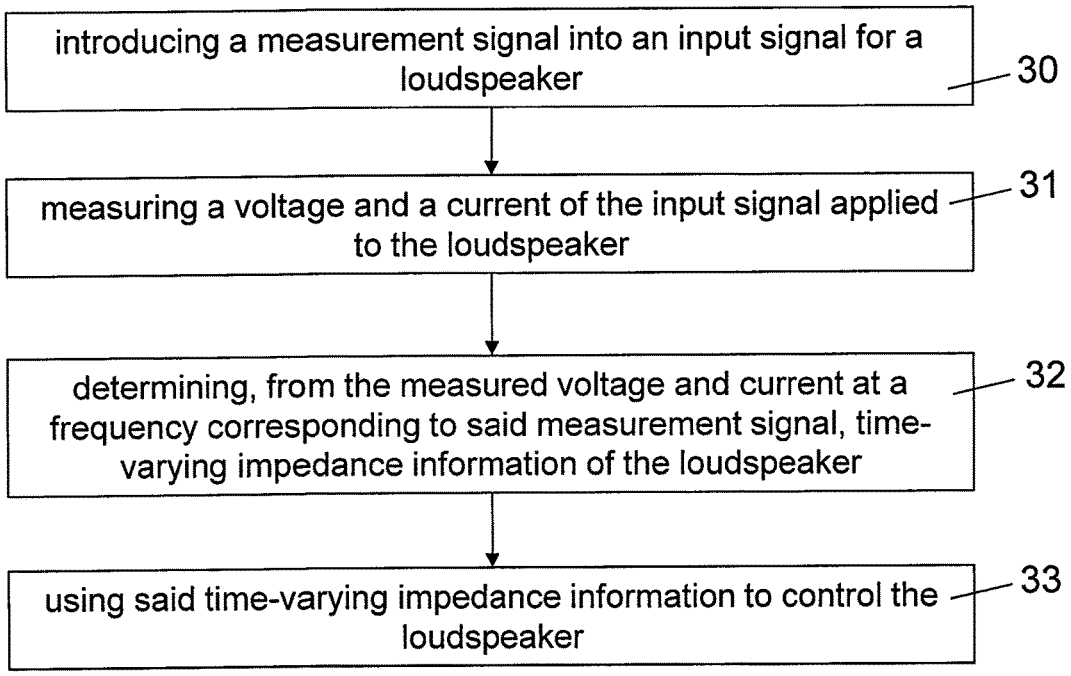
FIG. 3 shows a flow chart illustrating a method of controlling a loudspeaker.

FIG. 3 shows a flow chart illustrating the method of controlling a loudspeaker to provide mechanical protection comprising the following steps. Introducing a measurement signal into an input signal for a loudspeaker at step 30. Measuring a voltage and a current of the input signal applied to the loudspeaker at step 31. Determining, from the measured voltage and current at a frequency corresponding to said measurement signal, time-varying impedance information of the loudspeaker at step 32. Using said time-varying impedance information to control the loudspeaker at step 33.

The invention claimed is:

1. A loudspeaker controller for controlling a loudspeaker driven by an input signal, the loudspeaker controller comprising:

an amplifier to amplify the input signal;

a measurement signal generator configured to generate a measurement signal;

a mixer arranged prior to the amplifier to introduce the measurement signal into the input signal, the loudspeaker controller configured to determine time-varying impedance information of the loudspeaker based on the loudspeaker voltage, voicecoil inductance of the loudspeaker, and a measure of the loudspeaker current and provide for control of the loudspeaker in accordance with said time-varying impedance information, wherein the impedance of the loudspeaker varies with instantaneous displacement, wherein the controller compares the time-varying impedance information with predetermined bounds to determine the loudspeaker's relation to an excursion limit, and wherein the loudspeaker controller controls the input signal as a function of the time-varying impedance information.

2. The loudspeaker controller according to claim 1, wherein the controller is configured to derive a diaphragm displacement value from the time-varying impedance information.

3. The loudspeaker controller according to claim 1, wherein the measurement signal has a predetermined frequency and the loudspeaker controller measures the loudspeaker current of the loudspeaker at said predetermined frequency.

4. The loudspeaker controller according to claim 3, wherein said measurement signal comprises a pilot tone of predetermined frequency.

5. The loudspeaker controller according to claim 4, wherein said pilot tone has a frequency outside of audible range.

6. The loudspeaker controller according to claim 1, in which the controller is configured to measure a loudspeaker voltage and the loudspeaker current.

7. The loudspeaker controller according to claim 1, in which the controller is configured to, in providing for control of the loudspeaker, determine whether the time-varying impedance information exceeds a predetermined threshold.

8. The loudspeaker controller according to claim 7, wherein the controller is configured to control said loudspeaker if said threshold is exceeded.

9. The loudspeaker controller according to claim 1, wherein the measurement signal comprises a plurality of pilot tones, each having a different frequency, and the controller is configured to determine time varying impedance information at each frequency corresponding to the plurality of pilot tones.

10. The loudspeaker controller according to claim 1, wherein the measurement signal comprises noise introduced into the input signal over a particular frequency range.

11. The loudspeaker controller according to claim 1, wherein the controller is configured to use a short-time Fourier transform technique to determine the time-varying impedance information.

12. The loudspeaker controller according to claim 1, wherein the controller is configured to control the loudspeaker by acoustic signal processing of the input signal provided to the loudspeaker.

13. An integrated circuit comprising the loudspeaker controller as recited in claim 1.

14. An electronic device including a loudspeaker and a loudspeaker controller as recited in claim 1.

15. The loudspeaker controller according to claim 1, wherein the loudspeaker's excursion limit is determined from a calibration step based on determined impedance values.

16. A method of controlling an output of a loudspeaker comprising the steps of:

inputting an input signal and a measurement signal into a mixer;

amplifying the mixed signal and outputting the mixed signal to a loudspeaker;

measuring a loudspeaker current, the loudspeaker having the mixed signal applied thereto;

determining time-varying impedance information of the loudspeaker based on a loudspeaker voltage, voicecoil inductance of the loudspeaker, and the measured loudspeaker current;

providing for control of the loudspeaker in accordance with said time-varying impedance information, wherein the impedance of the loudspeaker varies with instantaneous displacement, comparing the time-varying impedance information with predetermined bounds to determine the loudspeaker's relation to an excursion limit; and controlling the input signal as a function of the time-varying impedance information.

17. The method according to claim 16, wherein the loudspeaker's excursion limit is determined from a calibration step based on determined impedance values.

* * * * *